US010553957B2

(12) United States Patent
Tubau et al.

(10) Patent No.: US 10,553,957 B2
(45) Date of Patent: Feb. 4, 2020

(54) ANTENNA INTEGRATING DELAY LENSES IN THE INTERIOR OF A DISTRIBUTOR BASED ON PARALLEL-PLATE WAVEGUIDE DIVIDERS

(71) Applicant: THALES, Courbevoie (FR)

(72) Inventors: Ségolène Tubau, Toulouse (FR); Hervé Legay, Plaisance du Touch (FR); Etienne Girard, Plaisance du Touch (FR); Jean-Philippe Fraysse, Toulouse (FR)

(73) Assignee: THALES, Courbevoie (FR)

( * ) Notice: Subject to any disclaimer, the term of this patent is extended or adjusted under 35 U.S.C. 154(b) by 0 days.

(21) Appl. No.: 16/046,920

(22) Filed: Jul. 26, 2018

(65) Prior Publication Data

US 2019/0036228 A1 Jan. 31, 2019

(30) Foreign Application Priority Data

Jul. 27, 2017 (FR) ..... 17 00799

(51) Int. Cl.
*H01Q 13/00* (2006.01)
*H01Q 21/00* (2006.01)
(Continued)

(52) U.S. Cl.
CPC ..... *H01Q 21/0031* (2013.01); *H01P 5/19* (2013.01); *H01Q 1/288* (2013.01); *H01Q 3/46* (2013.01);
(Continued)

(58) Field of Classification Search
None
See application file for complete search history.

(56) References Cited

U.S. PATENT DOCUMENTS 3,170,158 A * 2/1965 Rotman ..... H01Q 3/46 342/376
5,936,588 A * 8/1999 Rao ..... H01Q 3/24 342/372
(Continued)

FOREIGN PATENT DOCUMENTS

EP 3 113 286 A1 1/2017

OTHER PUBLICATIONS

Ettorre, et al., "Continuous Transverse Stub Array for Ka-Band Applications", IEEE Transactions on antennas and propagation, vol. 63, No. 11, pp. 4792-4800, Nov. 2015.
(Continued)

*Primary Examiner* — Trinh V Dinh
(74) *Attorney, Agent, or Firm* — Baker & Hostetler LLP

(57) ABSTRACT

A quasi-optical beamformer includes a power distributor composed of a succession of parallel-plate dividers extending in a YZ-plane from a first stage to a last stage, each parallel-plate divider comprising, in each of the stages of the corporate structure located under a higher stage, first and second parallel-plate waveguide branches leading to respective parallel-plate dividers of the following stage of the corporate structure, the beamformer furthermore including a plurality of lenses extending longitudinally along the X-axis in at least one stage of the power distributor, so as to apply a delay that is continuously variable along the X-axis, the lenses being placed in each of the branches of the dividers of at least one stage in the power distributor.

10 Claims, 7 Drawing Sheets

(51) Int. Cl.

| | |
|---|---|
| ***H01P 5/19*** | (2006.01) |
| ***H01Q 15/06*** | (2006.01) |
| ***H01Q 1/28*** | (2006.01) |
| ***H01Q 13/28*** | (2006.01) |
| ***H01Q 5/22*** | (2015.01) |
| ***H01Q 3/46*** | (2006.01) |
| ***H01Q 13/02*** | (2006.01) |
| ***H01Q 21/06*** | (2006.01) |

(52) U.S. Cl.
CPC ..... *H01Q 5/22* (2015.01); *H01Q 13/02* (2013.01); *H01Q 13/28* (2013.01); *H01Q 15/06* (2013.01); *H01Q 21/064* (2013.01)

(56) References Cited

U.S. PATENT DOCUMENTS

| | | | | |
|---|---|---|---|---|
| 10,135,150 | B2 * | 11/2018 | Legay | H01Q 15/04 |
| 10,236,589 | B2 * | 3/2019 | Legay | H01Q 25/008 |
| 2006/0202899 | A1 | 9/2006 | Milroy et al. | |
| 2017/0005407 | A1 * | 1/2017 | Legay | H01Q 15/04 |

OTHER PUBLICATIONS

Ettorre, et al., "A compact and high-gain Ka-band multibeam continuous transverse stub antenna", 2015 IEEE International Symposium on Antennas and Propagation & USNC/URSI National Radio Science Meeting.

Lu, "Beam-Scanning Continuous Transverse Stub Antenna Fed by a Ridged Waveguide Slot Array", IEEE Antennas and Wireless Propagation Letters, vol. 16, pp. 1675-1678, Feb. 6, 2017.

* cited by examiner

ANTENNA INTEGRATING DELAY LENSES IN THE INTERIOR OF A DISTRIBUTOR BASED ON PARALLEL-PLATE WAVEGUIDE DIVIDERS

CROSS-REFERENCE TO RELATED APPLICATIONS

This application claims priority to foreign French patent application No. FR 1700799, filed on Jul. 27, 2017, the disclosure of which is incorporated by reference in its entirety.

FIELD OF THE INVENTION

The invention relates to a multibeam antenna in particular applied to spatial communications, and intended to be integrated into satellites, or into ground stations. The antenna may irrespectively operate in emission or in reception, in a reciprocal way. In the following description, the multibeam antenna operates in emission.

BACKGROUND

Multibeam antennas are commonly used in spatial communications, on board a satellite (transmission of telemetry data, telecommunications), or on the ground (satcom terminal or user terminal of a telecommunications system). Among multibeam antennas, continuous linear radiating aperture antennas using a parallel-plate waveguide beamformer allow a plurality of beams to be formed over a wide angular sector. They moreover operate in a very wide band, because of the absence of resonant propagation modes. It is thus possible to obtain a multibeam continuous linear radiating aperture antenna that operates simultaneously at 20 and 30 GHz. They are lastly capable of radiating over a very vast angular sector, and have a much higher performance than an array of a plurality of radiating elements.

It is known to use a lens-like quasi-optical beamformer that will achieve collimation of the beams. The sources of the lens-like quasi-optical beamformer generate cylindrical waves, and the beamformer allows them to be converted into plane waves. FIGS. 1A and 1B illustrate such a quasi-optical beamformer. A parallel-plate waveguide 20 allows the waves to be guided in transverse-electromagnetic (TEM) mode, in which the electric field E and the magnetic field H vary in directions perpendicular to the propagation direction. The wave fronts are curved in the XZ-plane; in order to compensate for this curvature of the wave front, at least one lens, which may be of straight profile or of curvilinear profile, and which introduces a delay that is continuously variable along the X-direction, is provided. Straight-profile lenses comprise a protrusion 13 and an insert 17. These lenses are said to be straight-profile lenses because the protrusion and the insert have a straight and rectilinear profile in the XZ-plane. The height of the protrusion (along the Y-axis) is larger at the centre than at the sides and therefore a larger delay is created at the centre 14 of the protrusion than at the lateral edges 15, 16, the dimensions of the protrusion 13 being such that a plane wave front thus exits from the beamformer. A straight-profile lens allows the waves issued from a single central source 10 placed at the focal point of the lens to be correctly converted.

In contrast, when, in order to generate a plurality of beams, a plurality of sources 10 are distributed, with a distribution of curvilinear profile, around a central source 10*c*, a straight-profile lens may induce defocus aberrations due to the distance of the sources 10 with respect to the focal point. To solve this problem, it is possible to use what is called a curvilinear-profile lens, the profile of which is for example parabolic or elliptical. This type of lens is said to be a curvilinear-profile lens because the protrusion 13 and the insert 17, in addition to having a height that varies along the Y-axis (larger in the centre than at the sides), have a profile that is curvilinear in the XZ-plane, as illustrated in FIGS. 1C and 1D. Curvilinear-profile lenses, because of their geometry, are capable of correctly converting the cylindrical wave fronts emitted by a plurality of sources 10 that are also distributed curvilinearly in the XZ-plane. Use of curvilinear-profile lenses allows a larger number of focal points to be employed, and therefore a better beam quality to be obtained over a given angular sector. The degrees of freedom allowing a beamformer to be endowed with a plurality of focal points are in particular the curvilinear distribution of the sources $\mathbf{10}_1$, $\mathbf{10}_2$, . . . , $\mathbf{10}_M$, and the input and output curvatures of the protrusion, which correspond to the internal and external curvatures of the lens, respectively. The use of what are called curvilinear-profile lenses that have an input and output curvature that is variable in the XZ-plane thus advantageously adds an additional degree of freedom with respect to a straight-profile lens. Thus, the beams emitted by off-centred sources are better formed than with a straight-profile lens.

FIGS. 2A and 2B illustrate the operating principle of a pillbox beamformer, used in a CTS antenna of the prior art, which is described below. The incident cylindrical waves, emitted by at least one source 10, are emitted into a lower parallel-plate waveguide 21, then are reflected using a reflector, called a pillbox junction 23, towards an upper waveguide 22. The pillbox junction 23 is curved, and for example of parabolic or elliptical shape. It will be noted that the pillbox junction is a type of straight-profile lens, and the pillbox-junction quasi-optical beamformer is equivalent to a straight-profile-lens quasi-optical beamformer. Specifically, the straight-profile lens and the pillbox junction have the same curvature because they must introduce the same delay to convert a cylindrical wave into a plane wave. The only difference that there may be is that the beamformer may have a straight bend before and/or after the straight-profile lens that it contains whereas a pillbox beamformer comprises no bend other than the variable-height one of the junction.

Those skilled in the art may find, in patent application EP 3 113 286 A1, more details on quasi-optical beamformers comprising straight-profile lenses and/or curvilinear-profile lenses.

A radiating aperture, for example a horn, then allows the waves made plane by the beamformer to be radiated. However, a horn coupled to a parallel-plate waveguide necessarily has a shape that is very elongated along the X-axis, and therefore produces beams that are highly elliptical along the Y-axis. Thus, the beams have different widths, in particular in the main E- and H-planes of radiation, this being unsatisfactory. One way known to those skilled in the art of obtaining identical beamwidths in the two E- and H-planes therefore consists in arraying longitudinal horns, thereby dividing the parallel-plate waveguide issued from the beamformer into a plurality of sub-guides. The signals issued from the beamformer are thus divided using a distributor, for example based on one or more parallel-plate "T" dividers, then radiated via a plurality of juxtaposed horns, thus generating a circular beam, which is much better suited to satellite communications. The distributor is thus used to divide the power at equal amplitude and phase for the various horns.

The arrangement of a distributor at the output of a pillbox-type quasi-optical beamformer is known as a continuous transverse stub (CTS) antenna. The document "Continuous Transverse Stub Array for Ka-Band Applications" (Ettore et al., IEEE Transactions on antennas and propagation, vol. 63, no. 11, November 2015) describes such an antenna. FIG. 3A shows a perspective view of a CTS antenna, and FIG. 3B a cross section cut in the YZ-plane. The CTS antenna consists of a source 10, which may be an input feed, of a parallel-plate waveguide 20, of a pillbox junction 23, of a distributor 1, and of longitudinal radiating horns 5. When the source 10 is placed at the centre of the parallel-plate waveguide 20, along the X-axis, the width (dimension along the X-axis) of the longitudinal radiating horns 5 and of the distributor 1 is generally equal to that of the pillbox beamformer along the same axis. This is because the waves emitted by the central source are not or not greatly reflected from the edges of the distributor 1, and thus few reflections occur from the edges of the distributor 1.

FIG. 4 schematically illustrates, via an exploded view, the CTS antenna described in the document "Continuous Transverse Stub Array for Ka-Band Applications" (Ettore et al., IEEE Transactions on antennas and propagation, vol. 63, no. 11, November 2015), and equipped with a plurality of sources $\mathbf{10}_1, \mathbf{10}_2, \ldots, \mathbf{10}_M$. The use of a plurality of sources 10 allows as many separate and simultaneous signals to be generated, which signals propagate in different but coplanar directions, in the XY-plane in the interior of the parallel-plate waveguide 20, then in the XZ-plane in the distributor 1 and after emission via the longitudinal radiating horns 5. When the antenna is embedded in a satellite, the plurality of sources 10 thus allows separate zones of the Earth's surface to be covered simultaneously. The use of a plurality of input sources 10 in the aforementioned CTS antenna however has limits.

Firstly, the pillbox junction 23 has only a single focal point. Since the focus is perfect only for a source placed at the focal point of the reflector, defocus aberrations appear for sources 10 distant from the focal point of the reflector. These aberrations are the result of an imperfect conversion of the cylindrical waves into plane waves by the pillbox beamformer.

Moreover, as illustrated in FIG. 4, the wave emitted by an off-centred source 10 and reflected by the pillbox junction 23 in a very off-axis direction propagates obliquely in the distributor 1. To avoid reflections (single reflections or multiple reflections, from one edge to the other) of the waves from the sides of the distributor 1, it is then necessary to oversize the distributor 1 along the X-axis. This oversizing 4 of the distributor 1, which leads to an oversizing of the longitudinal radiating horns 5 along the same axis, has a cost in terms of weight, in particular in a satellite. It moreover depends on the targeted maximum pointing angle and on the propagation length in the distributor 1. It is all the larger if coverage is required over a vast angular sector along the axis of the main dimension of the longitudinal radiating horns 5, and if the electrical length of the distributor 1 is large.

SUMMARY OF THE INVENTION

The invention therefore aims to avoid an oversizing of the distributor and of the radiating aperture along the longitudinal axis of the radiating aperture, due to the waves emitted by input sources that are off-centred with respect to the focal point of the quasi-optical beamformer. The invention also aims, in certain embodiments, to avoid an imperfect focus of off-axis beams.

One subject of the invention is therefore a quasi-optical beamformer comprising a power distributor composed of a succession of parallel-plate dividers having a corporate structure made up of stages extending in a YZ-plane from a first stage to a last stage, the parallel plates of said dividers each having a main dimension along an X-axis orthogonal to the YZ-plane, each parallel-plate divider comprising, in each of the stages of the corporate structure located under a higher stage, first and second parallel-plate waveguide branches leading to respective parallel-plate dividers of the following stage of the corporate structure, the beamformer furthermore including a plurality of lenses extending longitudinally along the X-axis in at least one stage of the power distributor, so as to apply a delay that is continuously variable along the X-axis, said lenses being placed in each of the branches of the dividers of at least one stage in the power distributor.

Advantageously, the lenses are placed in a plurality of stages of the power distributor and have respective heights such that the continuously variable delay is applied gradually in the stages of the power distributor.

Advantageously, the lenses are placed in each stage of the power distributor.

According to one variant, the lenses are placed solely in the last stage of the power distributor.

Advantageously, each of the lenses of a given stage is a straight-profile lens.

Advantageously, each of the lenses of a given stage is a curvilinear-profile lens.

Advantageously, the power distributor comprises only straight-profile lenses placed in each stage of the power distributor.

Advantageously, the beamformer is connected to a plurality of sources that are oriented in different directions in the XY-plane, each of the sources being able to inject a wave into the distributor, the waves propagating in said various directions in the XY-plane, respectively, the lenses being suitable for collimating these waves.

The invention also relates to a multibeam antenna comprising at least one quasi-optical beamformer such as described above, and furthermore comprising a plurality of radiating horns, each radiating horn being connected to a branch of the last stage of the power distributor.

Advantageously, the multibeam antenna comprises a polarizer configured to circularly polarize the waves, which are emitted by the antenna with a linear polarization.

BRIEF DESCRIPTION OF THE DRAWINGS

Other features, details and advantages of the invention will become more clearly apparent on reading the description given with reference to the appended drawings, which are given by way of example and which show, respectively.

DETAILED DESCRIPTION

Figure 3A:
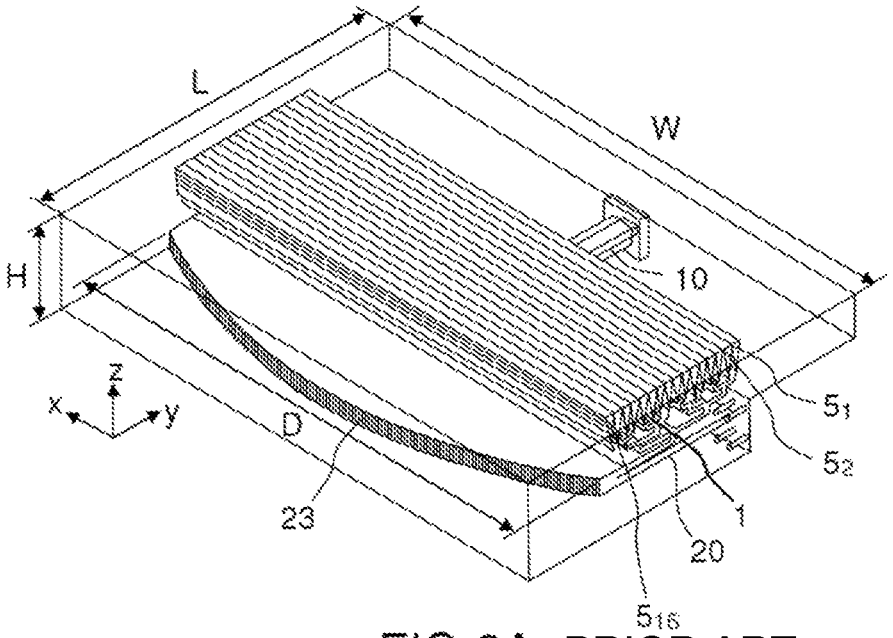
FIG.3A PRIOR ART
FIG. 3A: a perspective view of a prior-art CTS antenna.
Figure 3B:
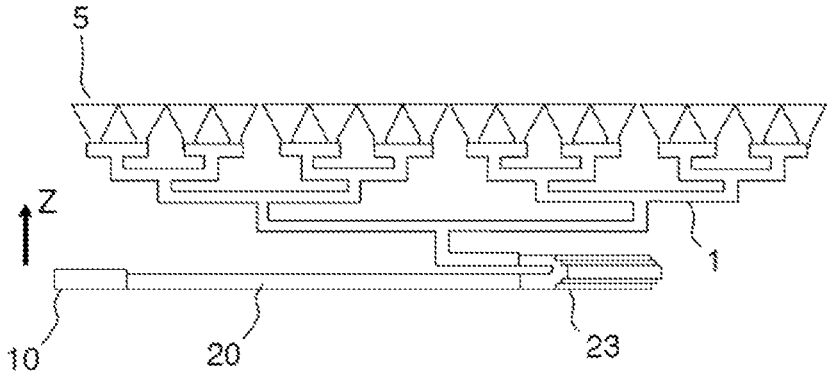
FIG.3B PRIOR ART
FIG. 3B: a view of the YZ-plane of the CTS antenna illustrated in FIG. 3A.
Figure 4:
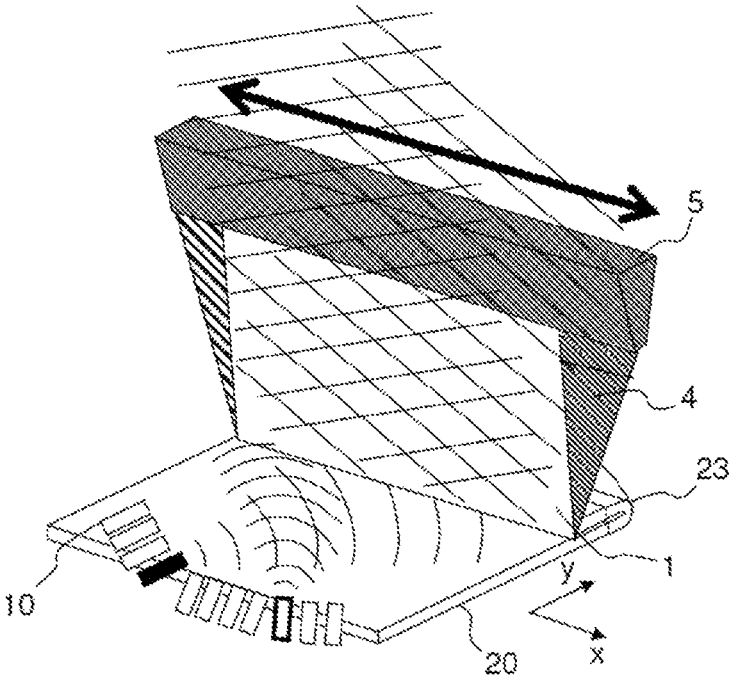
FIG.4 PRIOR ART
FIG. 4: an exploded view of the CTS antenna of FIGS. 3A and 3B.
Figure 5:
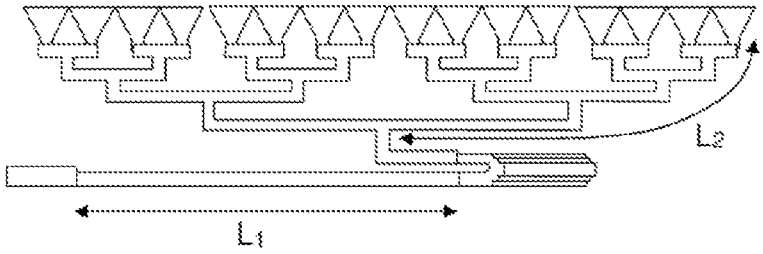
FIG.5 PRIOR ART
FIG. 5: a schematic illustration of the electrical paths travelled in the beamformer of FIGS. 3A and 3B.

FIG. 5 schematically illustrates electrical paths travelled in the prior-art beamformer also illustrated in FIGS. 3A and 3B. In a prior-art beamformer, the waves issued from the sources 10 travel an electrical length $L_1$, then are converted into plane waves on passage through the pillbox junction 23. The central source 10*c* must be placed at the focal point of the pillbox junction 23. The pillbox beamformer, which is composed of parallel-plate waveguides 20 and the pillbox junction 23, thus defines an electrical length $L_1$. The electrical length L2 then remaining to be travelled in the power distributor 1, which depends on the number of radiating elements and on the spacing between the radiating elements, is of the same order of magnitude as $L_1$. Based on this observation, the inventors propose to carry out the conversion of cylindrical waves to plane waves within the distributor 1, and before the horns 5 (according to a first and a second embodiment) or gradually (according to a third embodiment).

Figure 6A:
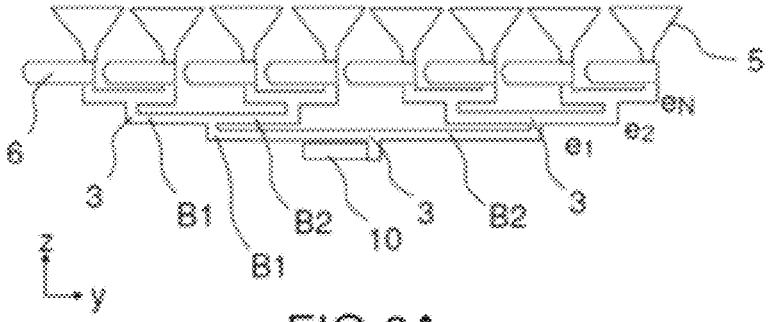
FIG. 6A: a schematic illustration of a first embodiment of the invention.

FIG. 6A illustrates a first embodiment, in which the wave conversion is carried out in the last stage of the distributor 1. The sources 10 emit waves, of cylindrical wave fronts, towards the power distributor 1. The power distributor 1 is composed of a plurality of stages $e_1, \ldots, e_N$. In the first stage $e_1$, which is directly connected to the sources 10, optionally via a straight 90° bend, a parallel-plate divider 3 composed of two branches B1 and B2 is located. It will be noted that the straight bend does not add any additional length to the beamformer; for this reason straight bends have no impact on the structure. The parallel-plate divider 3 is configured to distribute the electric field E issued from the sources 10. The parallel-plate dividers 3 may be unbalanced in order to modify the division of power and thus to control the distribution of power to the horns 5.

Figure 1A:
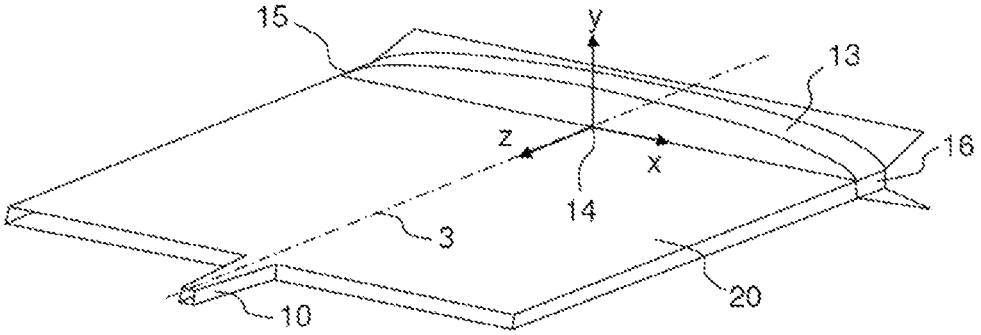
FIG.1A PRIOR ART
FIG. 1A: a prior-art lens-like quasi-optical beamformer.
Figure 1B:
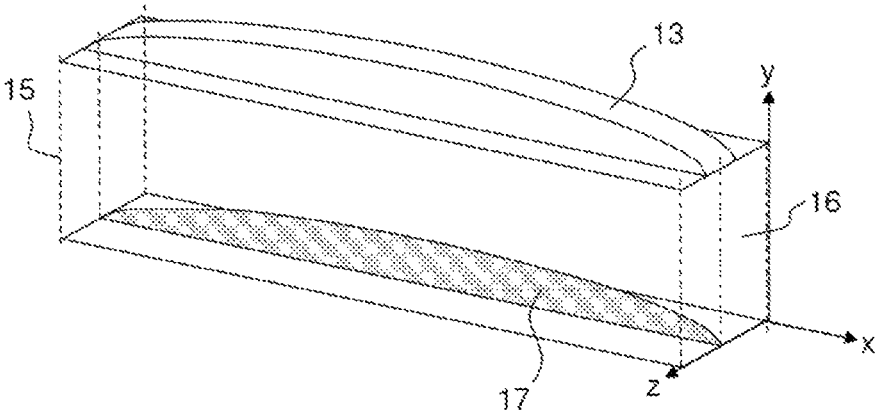
FIG.1B PRIOR ART
FIG. 1B: a straight-profile lens of a prior-art lens-like quasi-optical beamformer.
Figure 1C:
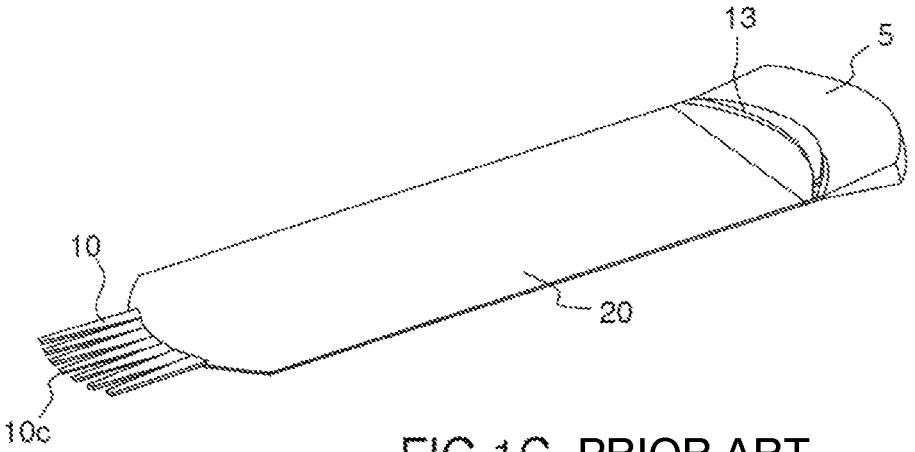
FIG.1C PRIOR ART
FIGS. 1C and 1D: a prior-art curvilinear-profile-lens quasi-optical beamformer.
Figure 6B:
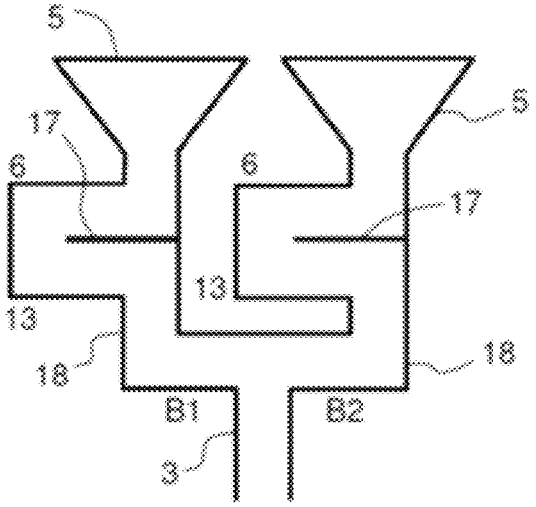
FIG. 6B: a cross section cut in the YZ-plane of the last stage of the beamformer according to the first embodiment.

As illustrated in FIG. 6B, in the last stage of the distributor, at the output of each branch B1, B2 of each divider 3 of this stage, optionally connected via a 90° bend 18, a straight-profile lens 6 is located. The straight-profile lens 6 may comprise a protrusion 13 equipped with an inset 17, a metal insert for example, that is placed between the parallel plates of each of the branches B1 and B2, just before the horns 5. The dimensions of the protrusion may be defined by a height variation of the insert along the Y-axis (see FIG. 1B). Typically, the height of the protrusion 13 may be zero or almost zero at the ends of the lens along the X-axis, whereas it may be maximal at the centre of the lens along the same axis. The insert may in particular be of "I" shape.

In this first embodiment, the distributor 1 divides, in each stage $e_1, \ldots, e_N$, the electric field E of the waves, the wave front of which remains cylindrical in the distributor. With respect to the CTS antenna of the prior art, for waves issued from the most off-axis sources, this distribution of the cylindrical waves generates far fewer reflections from the edges of the distributor 1. This is because, in the CTS antenna of the prior art, waves that are cylindrical (in the beamformer) then plane (in the distributor) propagate over a large distance (length of the beamformer added to the length of the distributor), whereas, according to the invention, the waves propagate in the distributor, directly from the sources, only over a length corresponding to that of the beamformer. The propagation distance of the waves is therefore shorter. Thus, it is no longer necessary with the antenna according to the invention, unlike in the prior art, to oversize the distributor 1 and the horns 5 along the X-axis with a view to preventing these reflections. Thus, in this embodiment, compactness along the X-axis is increased with respect to the CTS antenna of the prior art.

Moreover, the straight-profile lenses 6, which comprise only a single protrusion, are small in size along the Z-axis; thus, they have a low profile along the same axis. This embodiment however requires a certain spacing between the horns 5, along the Y-axis, because of the height of the straight-profile lenses 6.

Figure 7A:
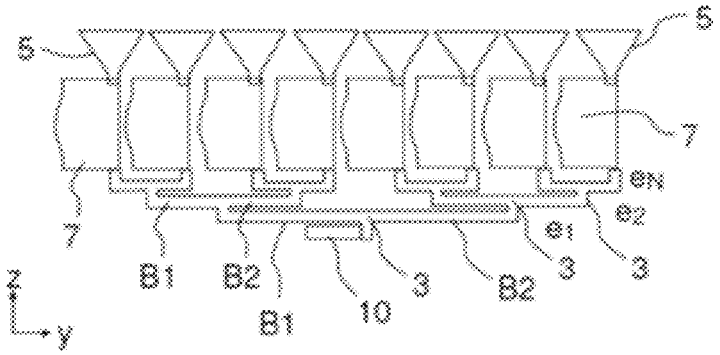
FIG. 7A: a schematic illustration of a second embodiment of the invention.

FIG. 7A illustrates a second embodiment, in which the waves are converted in the last stage of the distributor 1. The sources 10 emit cylindrical waves into the power distributor 1. The power distributor 1 is composed of a plurality of stages $e_1, \ldots, e_N$. A parallel-plate divider 3, composed of two branches B1 and B2, is located in the first stage $e_1$, which is directly connected to the sources 10, optionally via a 90° bend. The parallel-plate divider 3 is configured to distribute the electric field E issued from the sources 10. A curvilinear-profile lens 7 is located in the last stage of the distributor, at the output of each divider of this stage, and optionally connected via a 90° bend. As for the first embodiment, the waves propagate in the distributor, directly from the sources, only over a length corresponding to that of the beamformer. Thus, in this second embodiment, a saving in the area along the X-axis with respect to the CTS antenna of the prior art is also obtained. Moreover, by adding a degree of freedom with respect to the first embodiment, it is thus possible to provide the beamformer with a plurality of focal points.

In this second embodiment, the cylindrical waves are converted only in the last stage $e_N$. Thus, the height (along the Y-axis) of certain protrusions of the curvilinear-profile lens requires there to be a spacing between the horns 5. Thus, in this second embodiment, the spacing between the horns 5 is set by the height of the lenses, as in the first embodiment described above.

Figure 7B:
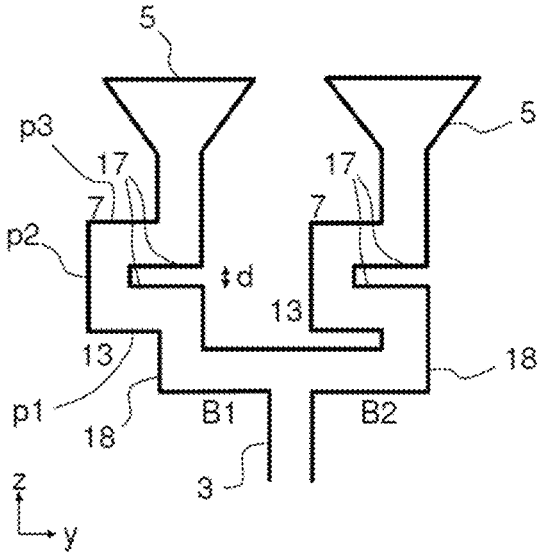
FIG. 7B: a cross section cut in the YZ-plane of the last stage of the beamformer according to the second embodiment.
Figure 7C:
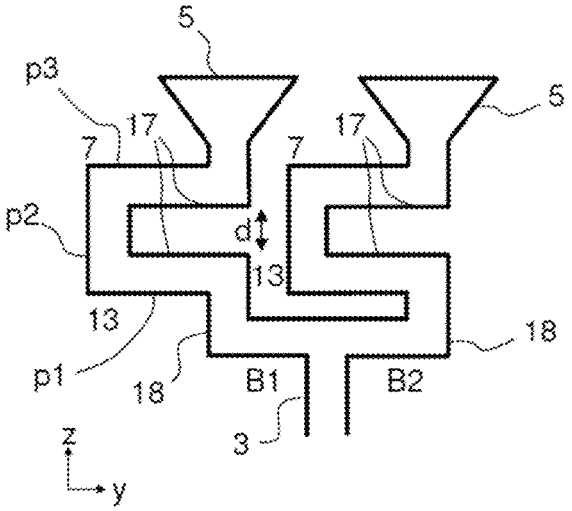
FIG. 7C: a cross section cut in the YZ-plane of the last stage of the beamformer according to the second embodiment.

FIGS. 7B and 7C illustrate two cross sections, cut in the YZ-plane, of curvilinear-profile lenses 7 placed in the last stage of the distributor, at two different locations of the lens 7 along the X-axis. The curvilinear-profile lens 7 is placed between the parallel plates of each of the branches B1 and B2, just before the horns 5. The curvilinear-profile lens 7 may comprise a protrusion 13, folded on itself, having a portion $p_1$ extending along the Y-axis, a portion $p_2$ extending along the Z-axis, and a portion $p_3$ extending along the Y-axis. The distance d between the two folded portions $p_1$ and $p_3$ that extend along the Y-axis increases from the ends of the lens along the X-axis (FIG. 7B) to reach a maximum at the centre of the lens (FIG. 7C). The height of the protrusion along the Y-axis also varies; it may be zero or almost zero at the ends of the lens along the X-axis, whereas it may be maximal at the centre of the lens along the same axis.

Figure 8:
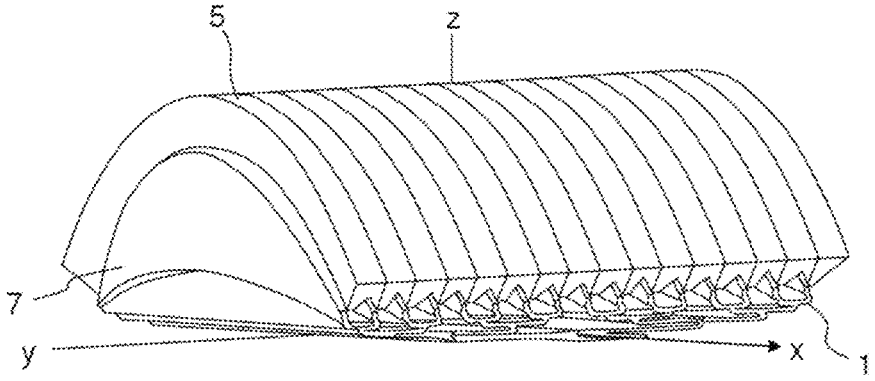
FIG. 8: an illustration of the antenna according to the second embodiment of the invention.

FIG. 8 illustrates such an antenna, in particular the power distributor 1, the lenses 7 and the horns 5. It may be seen that this antenna is much less compact, along the Z-axis, than the antenna of the first embodiment because of the dimensions of the curvilinear-profile lenses 7.

Figure 9:
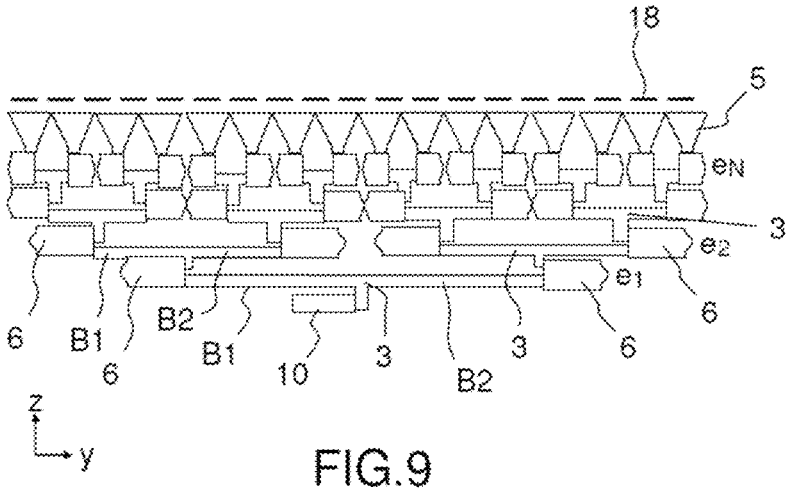
FIG. 9: a schematic illustration of a third embodiment of the invention.

FIG. 9 illustrates a third embodiment of the invention. The sources 10 emit cylindrical waves towards the power distributor 1. The power distributor 1 is composed of a plurality of stages $e_1, \ldots, e_N$. In the first stage $e_1$, directly connected to the sources 10, optionally via a 90° bend, is located a parallel-plate divider 3 that is composed of two branches B1 and B2. The parallel-plate divider 3 is configured to distribute the electric field E issued from the sources 10.

The lenses implemented in the third embodiment may take the form of straight-profile lenses comprising a protrusion (see FIG. 1B) in each of the branches B1, B2 of each divider. Each of the branches of the stage $e_1$ leads to a divider in a higher stage $e_2$. Thus, a parallel-plate divider 3 is connected to the first branch B1. This divider itself comprises two branches B1 and B2, each of the branches B1 and B2 of this parallel-plate divider 3 also comprising a straight-profile lens 6. The distributor 1 is thus defined by a corporate structure, in which the straight-profile lenses are located in each stage of the distributor 1, in the branches B1 and B2. Alternatively, the protrusion may be integrated into the junction of the branches B1 and B2; the contour of the junction is then no longer rectilinear, and must be modified so as to integrate the delay to be generated by the protrusion.

As for the first and for the second embodiment, the waves propagate in the distributor directly from the sources, only over a length corresponding to that of the beamformer. Thus, in this third embodiment, a saving in area along the X-axis with respect to the CTS antenna of the prior art is also obtained.

Such an arrangement provides an off-axis performance that is similar to the second embodiment, and therefore much better than that of the beamformers of the prior art. This is because, since the conversion to plane waves occurs gradually, there are no reflections from the edges of the distributor 1, contrary to the case in which the plane waves are highly inclined in the distributor 1. The multiplicity of protrusions allows the delays to be generated to be distributed and divided between the various protrusions, and thus a delay gradient, namely a delay that is a function of the position of the wave along the Z-axis, to be obtained. As in the second embodiment, this increase in the number of degrees of freedom with respect to the first embodiment thus prevents aberrations related to waves issued from highly off-axis sources, over a large angular sector. It is thus possible to endow the beamformer with a plurality of focal points. Moreover, the distribution of the lenses 6 makes it possible to decrease the amplitude of the delays to be generated in each protrusion, and therefore to limit the size thereof.

Figure 1D:
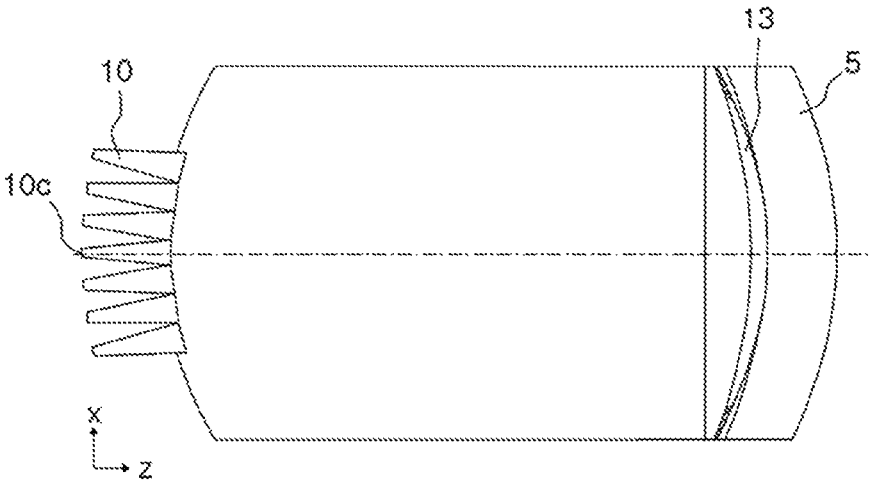
FIG.1D PRIOR ART
Figure 2A:
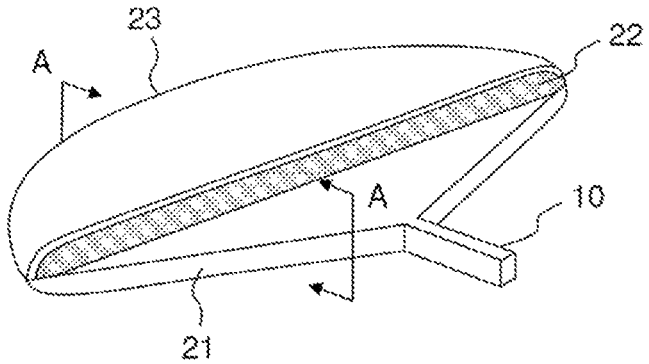
FIG.2A PRIOR ART
FIG. 2A: a prior-art pillbox beamformer.
Figure 2B:
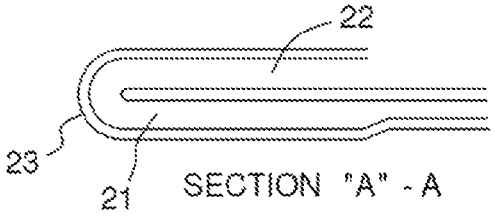
FIG.2B PRIOR ART
FIG. 2B: a cross section in the plane "A-A" of the pillbox beamformer illustrated in FIG. 2A.

The third embodiment was described with straight-profile lenses 6. This thus includes pillbox junctions, which are a certain type of straight-profile lens, as was described above. It may also be envisaged to distribute curvilinear-profile lenses 7 (see FIGS. 10 and 1D) in the distributor according to the third embodiment, while however taking into account the bulk of the curvilinear-profile lenses 7. Such a gradually distributed arrangement of curvilinear-profile lenses 7 according to the third embodiment allows additional degrees of freedom to be added in the case in which the use of straight-profile lenses does provide a sufficient number of degrees of freedom to allow a good performance to be obtained.

A plurality of radiating horns 5 is located at the output of the distributor, each radiating horn 5 being connected to a branch (B1, B2) of the last stage of the power distributor $e_N$. Each radiating horn 5 is configured to radiate the same field. Alternatively, the radiating horns 5 may have different power levels, in order to decrease the level of grating lobes. The beams thus generated are thinned in the E-plane, and may be circular, so as to be particularly suitable for spatial telecommunications. Since the conversion is gradual, the delay to be applied in the last stage $e_N$ in this embodiment is lower than that applied in the two preceding embodiments. Thus, contrary to the first two embodiments, the small height of the lens 6 (along the Y-axis) in the last stage $e_N$ allows the radiating horns 5 to be sufficiently close to one another along the Y-axis, and thus the problems created by grating lobes to be limited.

Preferably, the heights of each of the lenses of the branches B1, B2 of a given stage are identical, so that the delay is uniformly and evenly applied in each stage, and so that the various beams transmitted to the horns are correctly in phase, thus improving the quality of the beams over a given angular sector.

Other embodiments may be envisaged; in particular, one or more curvilinear-profile lenses 7 and one or more straight-profile lenses 6 may be placed in one stage.

A limitation of linear radiating aperture array antennas resides in the polarization of the radiated wave. Said polarization is linear, and oriented in the direction orthogonal to the parallel plates. However, many applications, in particular spatial communications, require the radiative wave to be circularly polarized. To this end, the antenna that is one subject of the invention advantageously comprises a polarizer configured to circularly polarize the waves, which are emitted by the antenna with a linear polarization. A septum polarizer may be integrated into the antenna; alternatively, a polarizing radome 18, schematically shown in FIG. 9, may cover the antenna according to the invention.

The invention claimed is:

1. A quasi-optical bears beamformer comprising a power distributor composed of a succession of parallel-plate dividers having a corporate structure made up of stages extending in a YZ-plane from a first stage ($e_i$) to a last stage ($e_N$), each parallel-plate divider comprising, in each of the stages of the corporate structure located under a higher stage, first and second parallel-plate waveguide branches leading to respective parallel-plate dividers of the following stage of the corporate structure, wherein the beamformer further comprising a plurality of lenses (6, 7) extending longitudinally along an X-axis, which is orthogonal to the YZ-plane, in at least one stage of the power distributor (1), so as to apply a delay that is continuously variable along the X-axis, wherein said lenses being placed in each of the branches of the dividers of at least one stage in the power distributor.

2. The quasi-optical beamformer according to claim 1, the lenses being placed in a plurality of stages ($e_1, \ldots, e_N$) of the power distributor and having respective heights such that the continuously variable delay is applied gradually in the stages of the power distributor.

3. The quasi-optical beamformer according to claim 1, the lenses being placed in each stage ($e_1, \ldots, e_N$) of the power distributor.

4. The quasi-optical beamformer according to claim 1, the lenses being placed solely in the last stage ($e_N$) of the power distributor.

5. The quasi-optical beamformer according to claim 1, each of the lenses of a given stage being a straight-profile lens.

6. The quasi-optical beamformer according to claim 1, each of the lenses of a given stage being a curvilinear-profile lens.

7. The quasi-optical beamformer according to claim 5, the power distributor comprising only straight-profile lenses placed in each stage ($e_1, \ldots, e_N$) of the power distributor.

8. The quasi-optical beamformer according to claim 1, said former being connected to a plurality of sources that are oriented in different directions in the XY-plane, each of the sources being able to inject a wave into the distributor, the waves propagating in said various directions in the XY-plane, respectively, the lenses being suitable for collimating these waves.

9. A multibeam antenna comprising at least one quasi-optical beamformer according to claim 1, and furthermore comprising a plurality of radiating horns, each radiating horn being connected to a branch of the last stage of the power distributor ($e_N$).

10. The multibeam antenna according to claim 9, comprising a polarizer configured to circularly polarize the waves, which are emitted by the antenna with a linear polarization.

* * * * *